United States Patent [19]

Bitter et al.

[11] Patent Number: 4,753,250

[45] Date of Patent: Jun. 28, 1988

[54] PROCESS FOR PRODUCING TOBACCO FILTER TO ADSORB MATERIALS HARMFUL TO HEALTH, ESPECIALLY ALDEHYDES IN THE SMOKE OF TOBACCO

[75] Inventors: István Bitter, Budapest; József Gábor, Pécs; Sándor Hernádi; Viktória Horváth, both of Budapest; Sándor Irimi, Pécs; Ádám Molnár, Pécs; István Rusznák, Budapest; Lajos Trézl, Budapest, all of Hungary

[73] Assignee: Pecsi Dohanygyar, Pécs, Hungary

[21] Appl. No.: 788,815

[22] Filed: Oct. 18, 1985

[30] Foreign Application Priority Data

Apr. 29, 1985 [HU] Hungary ..... 1627/85

[51] Int. Cl.[4] ..... A24D 3/08

[52] U.S. Cl. ..... 131/334; 131/335; 131/342; 493/47

[58] Field of Search ..... 131/334, 335, 342; 493/47

[56] References Cited

U.S. PATENT DOCUMENTS

| | | | |
|---|---|---|---|
| 3,339,558 | 9/1967 | Waterburg | 131/335 |
| 4,038,992 | 8/1977 | Ogasa et al. | 131/342 |
| 4,317,460 | 3/1982 | Dale et al. | 131/334 |

FOREIGN PATENT DOCUMENTS

| | | | |
|---|---|---|---|
| 1204018 | 9/1970 | United Kingdom | 131/337 |

*Primary Examiner*—V. Millin

*Attorney, Agent, or Firm*—Schweitzer & Cornman

[57] ABSTRACT

A process for producing cigarette filters comprising a compound containing L-ascorbic acid and having the compound added to an adsorptional filter material in a quantity of 5–200% of the amount of said adsorptional filter.

6 Claims, No Drawings

PROCESS FOR PRODUCING TOBACCO FILTER TO ADSORB MATERIALS HARMFUL TO HEALTH, ESPECIALLY ALDEHYDES IN THE SMOKE OF TOBACCO

The invention relates to a procedure by which an active material is incorporated into a tobacco filter, preferably cigarette filter of known composition which makes the smoke filter capable of reducing or eliminating the specially harmful materials, which do not get absorbed either mechanically or chemically, mainly aldehydes and especially formaldehyde of carcinogen character besides tar and other harmful materials of high boiling point in chemosorption way.

There are several procedures known worldwide today which serve the purpose of filtering tobacco smoke. The most common are those consisting of homogeneous materials containing fibrous materials and functioning mechanically. These are the following:

specially applied paper,
viscose base filters,
cellulose acetate base filters.

Besides homogeneous filters bi ilters are also common, for example:

combination of paper and cellulose acetate,
combination of paper and viscose.

Further, there are materials known by the incorporation of which into the filter the filtering efficiency may be increased by adsorption so that a greater part of smoke becomes retainable. Exceeding the filtering potentials of fibrous filters, these materials are capable of adsorbing materials in the gaseous phase not being condensed in fibrous filters. Such materials are:

active charcoals,
silicates of porous structure,
filtering perlite.

The GDR patent specification Nr. 69 291 describes a filter making procedure which applies the silicagel adsorbent together with active charcoal (5–15%).

The FRG patent specification Nr. 1 657 243 describes a procedure according to which the granular filter material (preferably charcoal) is mixed with the granules of a material (preferably polystyrol) that can get swollen later on by heat or chemical reaction. In the course of swelling the empty spaces around the filter granules will be filled, thus smoke is forced to go through the filtering granules. The most improved cigarette filters (multifilters) known so far basically take advantage of the special varieties of different proportions of materials which, as mentioned above, filter by mechanical or adsorptional way. Consequently, the materials in multifilters adsorb or retain a given portion of the harmful and non-harmful content of cigarette smoke depending on the particular characters of these materials, on the structure of the filter and the porosity (micro, mezo, macro) of the great-surface adsorbents (e.g. active charcoal) which determine that which materials of which molecule masses and in which extent may be adsorbed.

There is a great variety of multifilter cigarettes produced on world scale. Philip Morris multinational concern with USA headquarters produces registered filters under the name "Multifilter" the filter of which consists of a black cellulose acetate base covered with a specified amount and quality of activated charcoal. This section of the combination of filters is closed with a white cellulose acetate cover filter at the sucking end of the cigarette.

With its headquarters in Switzerland, Baumgartner multinational produces cigarette filters of fibrous structure supplied with different adsorbents in a great variety and composition. The most common of these solutions are those consisting of paper or cellulose acetate base complemented with activate charcoal or some versions of silicates in a given ratio. These filtering combinations are closed with white fibrous coverfilters.

A procedure is also known in which two fibrous, cylindershaped filters of either the same or different materials are disconnected by an interspace of 3 to 5 mm which is then filled out with adsorbents of a granular structure, mostly charcoal or some type of silicates, or the mixture thereof.

The Hungarian patent specification Nr. 176 508 describes a procedure according to which tobacco smoke filters are prepared by adding activated charcoal or filter perlite or the mixture thereof to a fibrous filter material (e.g. paper) in a quantity corresponding to a given cigarette type. This smoke filtering combination is then closed with white cellulose-acetate filter on the sucking end of the cigarette. Such Hungarian products are among others Sopianae and its menthol version and also Sopianae Lady and Sopianae Junior.

All these more improved solutions to filter tobacco smoke with the help of different materials have the common disadvantage, that tarry, mostly aromatic compounds resulting from the burning of tobacco and also nicotine or a part thereof can be adsorbed only physically on the great surface of the filter.

Materials of different molecular mass in the smoke are adsorbed by the adsorbents on specific temperatures. Materials of smaller molecular mass are adsorbed by the filters on lower temperatures. One part of the materials of greater molecular mass gets adsorbed as early as the section between the place of burning and the filter, in the cigarette stem. Another part, however, especially the molecules of smaller mass are adsorbed only in the filter. As the burning approaches the filter, the mass of the condensed smoke increases. When the stem is as short as 10 to 15 mm only, materials previously adsorbed here at the back of the stem are discharged and rush towards the filter. Since then the burning is very close to the filter, the temperature increases and rises to 70° C. at the end.

Proportionately with the rise of the temperature in the filter desorption of materials of mainly smaller molecular mass, primarily aldehydes previously adsorbed takes place.

This is why the smoker feels with the first inhalings that it is fairly soft and smooth, but later it becomes rather crapy and tart. Since the materials harmful to the health are of different molecular masses due to adsorption and subsequent desorption smokers smoking the same number of cigarettes can get into their organisms harmful materials in differing quantities depending whether they choose to smoke their cigarettes to the very end or only partially. This applies especially to aldehydes of small molecular mass as it is their desorption that starts the earliest and in the most complete way.

According to our measurings ca. 80 to 90 percent of the aldehyde content of tobacco smoke cannot remain adsorbed in the filter when the cigarette is smoked to its end (a stem of 10 to 15 mm) due to the increasing temperature. These materials then find free way into the smoker's organism.

It is a well-attested fact today that the relatively great quantity of gaseous aliphatic aldehydes occuring in tobacco smoke (e.g. formaldehyde, acetaldehyde, acrolein) represent a far greater hazard to health than tarry products (G. A. Wartew: "The health hazards of formaldehyde", Journal of Applied Toxicology, 1983. 3, 121–126; J. E. Gibson: Formaldehyde Toxicity, Hamisphere Publishing Corporation, New York, 1983; IARC (International Agency for Research on Cancer): "Monography on the evaluation of the carcinogen risk of chemicals to humans", Lyon, 1981, 346–389; V. S. Goldmacher et al.: "Formaldehyde is mutagenic for cultured human cells", Mutation Research, 1983. 116, 417–422).

Formaldehyde especially constitutes health hazard whose cancer-inducing effect was proved by Swenberg and associates in 1980 who made rats be exposed to carcinogen effects of formaldehyde vapour at different time intervals (6 hours per day, 5 days per week) and in different concentration (2.4 mg/m$^3$, 6.7 mg/m$^3$, 17.2 mg/m$^3$) for 24 months. The surprising finding was that the carcinogenity of formaldehyde was not of linear character but it occured outstandingly after a certain value of concentration. Thus, accordingly, with the concentration of 17.2 mg/m$^3$ aqueous cell carcinoma developed at the nasal cavity in at least 50 percent of the rats affected. (J. A. Wenberg et al.: "Induction of Squamous Cell Carcinomas at the Rat Nasal Cavity by Inhalation Exposure to Formaldehyde Vapor", Cancer Research, 1980. 40, 3398–3402; J. A. Swanberg et al.: "Non linear biological response to formaldehyde and their implications for carcinogenic risk assesment", Carcinogenesis, 1983. 4, 945–952.)

If we take into consideration that an average 40 to 140 mg/m$^3$ formaldehyde is present in tobacco smoke depending on the sort of tobacco, we can state that smokers are exposed to a hazard of carcinogenity far greater than the critical lower threshold value (17.2 mg/m$^3$) for formaldehyde damage. Even the smallest measured formaldehyde concentration of 40 mg/m$^3$ is far higher than the lowest threshold value of 17.2 mg/m$^3$ which already means substantial carcinogenity. (G. A. Wartew: "The health hazards of formaldehyde", Journal of Applied Toxicology, 1983, 3. 121–126.)

Experiments have shown that in spite of the fact that materials of small molecular mass, especially aldehydes are the first to be adsorbed during the first phase of smoking a cigarette, with the increase of temperature in the filter a steadily increasing description takes place as a consequence of which the filter, depending on the actual temperature, releases 70 to 80 percent of the aldehydes previously adsorbed.

The object of the invention is to eliminate the disadvantages of the common procedures and to produce a filter which greatly reduces the amount of materials in cigarette smoke being harmful to health but not being adsorbed either mechanically or otherwise; such materials include primarily aldehydes, especially formaldehyde which has a strong carcinogenic effect.

The invention is based on the recognition that a chemical material, preferably a compound including an element of enediol

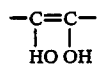

structure is incorporated into the filter, with which harmful materials, especially aldehydes enter into chemical reaction after adsorption on fibrous and especially granulous adsorbents, the speed of which chemical reaction increases with the rise of temperature and the description of the aldehydes thus transformed cannot take place. This means that besides the mechanical and adsorptional filtering also the chemosorptional function, which is the essence of the invention, exists. This is a procedure in which a great percentage of the aldehydes, especially formaldehyde to be found in the smoke is retained in the filter by chemical binding thus preventing harmful materials from getting into the human organism.

It is well supported in the literature that enediols, e.g. L-ascorbic acid, reacts with formaldehyde at 60° C. in an aqoueous medium while $CO_2$ is produced and L-ascorbic acid loses its reduction potential. (F. J. Reithel et al.: "Studies on the reactions between formaldehyde and enediols", J. Am. Chem. Soc., 70, 898–900., 1948. F. J. Reithel et al.: "On the nature of the reaction between ascorbic acid and formaldehyde", J. Am. Chem. Soc. 71, 1879–1880, 1949).

Our own experiments have also supported $CO_2$ production and we have also found that the addition of formaldehyde on L-ascorbic acid proceeds quickly and the saturated state of the latter ceased (L. Trézl et al.: "N-methylation and N-formylation reactions between L-lysine and formaldehyde inhibited by L-ascorbic acid and their biochemical consequences" (in Hungarian), Biológia 30 (1982), 55–71; L. Trézl et al.: "Spontaneous N-methylation and N-formylation reactions between L-lysine and formaldehyde inhibited by L-ascorbic acid", Biochem. J., 214, (1983), 289–292.)

It has been observed in our experiments that when a filter containing activated charcoal, which had been impregnated or mixed with L-ascorbic acid, the amount of formaldehyde in the smoke decreased significantly, ca. by 60 to 70 percent depending on the L-ascorbic acid content of the filter.

The experiments have also thrown light on the nature of the process. Since the chemical character of the L-ascorbic acid is changed after its reaction with formaldehyde, compounds of enediol-type, preferably L-ascorbic acid, can be proved to undergo a process of chemosorption.

The following table shows the decrease of the formaldehyde content in tobacco smoke as a function of the composition of the filter:

| Filter composition | Formaldehyde content μg/l g tobacco | Decrease in formaldehyde content compared to control in % |
|---|---|---|
| (1) Paper filter (control) | 649 | 0 |
| (2) 30 mg charcoal in paper filter | 584 | −10.02 |
| (3) Paper filter + 30 mg L-ascorbic acid | 393 | −39.45 |
| (4) Paper filter + 24 mg active charcoal + 25 mg L-ascorbic acid | 319 | −50.84 |

-continued

| Filter composition | Formaldehyde content µg/l g tobacco | Decrease in formaldehyde content compared to control in % |
|---|---|---|
| (5) Paper filter + 25 mg charcoal + 25 mg L-ascorbic acid + 5 mg $CuSO_4.5H_2O$ | 263 | −59.48 |

The rather unsignificant difference between item 1 and item 2 shows the desorption of aldehydes, while the decreasing formaldehyde values in item 3 through 5 indicate chemosorption unambiguously.

The desired positive effect can be increased further by applying either more charcoal or other granules adsorbents or more L-ascorbic acid or even a greater amount of other catalyst and thus a 65 to 70 percent decrease in formaldehyde content can be reached.

According to our findings .cigarette filters treated with L-ascorbic acid in the above described way are capable of chemically adsorbing aldehydes, only 10 percent of which can be retained by adsorbents under normal circumstances.

A further advantage of the filter produced according to the process of the invention is that it contains no materials harmful to health, what is more, L-ascorbic acid (the well-known vitamine C), an indispensable biocatalyzer is straightforwardly favourable to humans.

Furthermore, when L-ascorbic acid reacts with formaldehyde, $CO_2$ and carbohydrats related polyhydroxy compounds are produced, since formaldehyde enters into reaction with the acidic methin-group (CH, the ketone-form of L-ascorbic acid) to be found next to the carbonyl-group of the lactone-ring of L-ascorbic acid while at the temperature of the filter (50° to 60° C.) a stable adduct forms which is bound strongly to activated charcoal.

An other advantage of the filter produced according to the invention is that the amount of formaldehyde, which may be extracted from tobacco smoke increases significantly with the increase of burning time. According to measurements the temperature of the filter reaches 65° to 70° C. by the end of the burning, which is fairly favourable to chemosorptional processes, the speed of the chemical reaction increases suddenly in contradiction to the common filters, in the case of which the efficiency of the physical sorption decreases due to increasing desorption with the rise of the temperature.

The chemical processes taking place between L-ascorbic acid and formaldehyde are consistent with the findings of Fodor et al. (G. Fodoer et al.: "A new role for L-ascorbic acid: Michael donor to $\alpha,\beta$-unsaturated carbonyl compounds", Tetrahedron, 1983. 39, 2137–2145), who observed that L-ascorbic acid reacts with acrolein on the same carbon atom we found in our experiments for formaldehyde. This implies that the filter of the invention is also capable of binding acrolein. This fact greatly contributes to the improvement of the taste factor of cigarettes.

Since it is attested in the literature (e.g. F. J. Reithel: "Studies on the reactions between formaldehyde and enediols", J. Am. Chem. Soc., 1948, 898–900) that reactions betwen formaldehyde and other compounds of enediol-types (like reduction, reductinic acid, hydroxytetronic acid, dihydroxymaleinic acid dehydro-ascorbic acid) are similar to that with L-ascorbic acid, it is reasonable to assume that the above listed compounds of enediol-type are also capable of binding formaldehyde (reducton=3-hydroxy-2-oxopropanal).

The invention relates to a process for producing filters to adsorb materials, which represent a health hazard in the cigarette smoke epsecially aldehydes by using mechanical (fibrous) and adsorptional (activated charcoal) filters wherein an increased filtering efficiency is obtained by a chemosorption process by adding compounds containing enediol

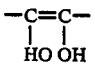

structural elements to the mechanical and/or adsorbent filtering materials, which may react with materials not adsorbed mechanically or adsorptionally, especially with aldehydes with a reaction speed increasing parallel with the rise of the temperature while preventing the desorption of aldehydes, thus decreasing the amount of harmful materials, especially aldehydes in the smoke, preferably by at least 40 percent, wherein the other process step are performed in a manner known per se. The following Examples illustrate the process of the invention.

EXAMPLE 1

L-ascorbic acid is added in the following quantities to activated charcoal or the mixture of activated charcoal and other granular adsorbent in the function of filtering efficiency to be achieved. The values given relate for one cigarette.

| Activated charcoal or mixture in mg | L-ascorbic acid in mg |
|---|---|
| 10 | 5–20 |
| 20 | 15–40 |
| 30 | 25–60 |
| 40 | 35–80 |
| 50 | 45–100 |
| 60 | 55–120 |

The two substances are mixed thoroughly, homogenized and applied on the fibrous base filter in known manner, than the filter is manufactured further according to known procedure.

EXAMPLE 2

The homogenized mixture of hydrophobic filtering perlite and L-ascorbic acid is applied on a vehicle of paper or cellulose acetate. The following amounts of the acid are used per cigarette:

| Filter perlite mg | L-ascorbic acid mg |
|---|---|
| 5 | 10–30 |
| 10 | 20–40 |
| 20 | 30–50 |
| 30 | 40–60 |
| 40 | 50–80 |
| 50 | 60–120 |

Further the procedure is continued in known manner.

EXAMPLE 3

Aqueous solution of L-ascorbic acid, preferably a 5 to 25 percent solution is applied on filtering paper, in the quantity of 10 to 100 mg dry substance per cigarette. Then the filter is dried, rolled into rod shape and the procedure is continued in known manner.

EXAMPLE 4

Powder or granular L-ascorbic acid is spread equally on the surface of fibrous paper or cellulose acetate, preferably in the quantity of 10 to 100 mg per cigarette, then procedure is continued in a known manner.

EXAMPLE 5

L-ascorbic acid or a mixture of it with either activated charcoal or filter perlite or the mixture thereof is filled into the gap of preferably 3 to 5 mm between two filters in quantities specified in examples 1 through 3. Further the procedure proceeds as usual.

EXAMPLE 6

In the ways specified in examples 1 to 5 the effect of L-ascorbic acid is further increased by catalysts so that finely pulverized $CuSO_4.5H_2O$ homogenized with either L-ascorbic acid or granular adsorbents, is added to the mixture in the quantity of preferably 5 to 30 percent calculated on the amount of the applied L-ascorbic acid.

EXAMPLE 7

L-ascorbic acid is mixed with some other material of low melting temperature and after solidifying a cylindershaped filter of porous structure is obtained which then can be used to produce the desired smoke filtering device.

EXAMPLE 8

In the procedures specified in examples 1 through 7 either mixed with L-ascorbic acid or to replace it other compounds of the enediol-group, like reducton, (3-hydroxy-2-oxopropanal), reductinic acid, hydroxytetronic acid, dihydroxy-maleinic acid, dehydro-ascorbic acid or any combination thereof, are applied.

We claim:

1. A process for producing cigarette filters to adsorb substances which represent a health hazard in cigarette smoke, the process including providing a filter element of adsorptional material, adding to said filter element a compound in a manner whereby said compound reacts, within the filter element with substances including aldehydes not adsorbed by said filter element with a reaction speed increasing proportionally with the rise of the temperature and prevents the desorption of aldehydes, thereby decreasing the amount of harmful materials in the cigarette smoke, characterized by (a) said compound containing enediol structural elements comprising L-ascorbic acid, (b) adding said L-ascorbic acid to said adsorptional filter material in a quantity of 5–200% of the amount of said adsorptional filter material to form a homogenized mixture, (c) applying said homogenized mixture to a fibrous filtering material base.

2. The process according to claim 1, further characterized by adding to said filter element 5–30% finely pulverized $CuSO_4.5H_2O$ to provide a catalyst to increase the chemosorptional effect of said compound containing enediol structural elements.

3. The process according to claim 1, characterized by (a) spreading said L-ascorbic acid in pulverized, granular form on said fibrous filtering material in the quantity of 10–100 milligrams per cigarette.

4. The process according to claim 16, further characterized by (a) impregnating said fibrous filtering material with 5–25% aqueous solution of said L-ascorbic acid to obtain a quantity of 10–100 milligrams of L-ascorbic acid per cigarette.

5. The process according to claim 1, further characterized by (a) providing said filter element in the form of two fibrous structured filters, (b) arranging said two fibrous structured filters to form a gap therebetween, (c) said compound containing enediol structural elements comprising L-ascorbic acid, (d) providing an homogenized mixture of porous L-ascorbic acid, and (e) applying said homogenized mixture of porous L-ascorbic acid to said gap to provide a quantity of 10–100 milligrams L-ascorbic acid per cigarette.

6. The process of claim 1, in which (a) said adsorptional filter is activated charcoal.

* * * * *